US012384603B2

(12) United States Patent
Klatt

(10) Patent No.: US 12,384,603 B2
(45) Date of Patent: Aug. 12, 2025

(54) SEALING CAP FOR A CONTAINER CLOSURE AND CONTAINER CLOSURE COMPRISING SUCH A SEALING CAP

(71) Applicant: PROTECHNA S.A., Fribourg (CH)

(72) Inventor: Bernd Klatt, Ruppach-Goldhausen (DE)

(73) Assignee: PROTECHNA S.A., Fribourg (CH)

( * ) Notice: Subject to any disclaimer, the term of this patent is extended or adjusted under 35 U.S.C. 154(b) by 0 days.

(21) Appl. No.: 18/025,822

(22) PCT Filed: Jul. 8, 2021

(86) PCT No.: PCT/EP2021/069054
§ 371 (c)(1),
(2) Date: Mar. 10, 2023

(87) PCT Pub. No.: WO2022/053202
PCT Pub. Date: Mar. 17, 2022

(65) Prior Publication Data

US 2023/0286705 A1 Sep. 14, 2023

(30) Foreign Application Priority Data

Sep. 14, 2020 (DE) ..... 10 2020 123 861.4

(51) Int. Cl.
*B65D 41/58* (2006.01)
*B65D 39/02* (2006.01)
(Continued)

(52) U.S. Cl.
CPC ..... *B65D 41/58* (2013.01); *B65D 39/025* (2013.01); *B65D 39/082* (2013.01); *B65D 55/0863* (2013.01); *B65D 2401/25* (2020.05)

(58) Field of Classification Search
CPC ..... B65D 41/04; B65D 41/58; B65D 39/025; B65D 39/082; B65D 51/18;
(Continued)

(56) References Cited

U.S. PATENT DOCUMENTS 1,847,108 A 3/1932 Hirsch et al.
4,320,861 A * 3/1982 Rieke ..... B65D 55/0863 222/541.9
(Continued)

FOREIGN PATENT DOCUMENTS

CL 200500626 5/2006
DE 3532925 C1 9/1986
(Continued)

OTHER PUBLICATIONS

PCT International Search Report and Written Opinion, PCT/EP2021/069054, Oct. 19, 2021, 15 pages.
(Continued)

*Primary Examiner* — Orlando E Aviles
*Assistant Examiner* — Brijesh V. Patel
(74) *Attorney, Agent, or Firm* — Quarles & Brady LLP

(57) ABSTRACT

A sealing cap made of an elastic plastic material for a container closure includes a container socket base formed on a container for disposing a container socket having a bung plug disposed in a bung socket formed on the container socket base, the sealing cap comprising a lid disk which has a fastening means disposed on an underside of the lid disk and provided with a snap-lock means for forming a snap-lock connection with the bung plug, and an edge skirt disposed at the circumference of the lid disk and connected to the lid disk via a predetermined breaking means. The lid disk has a support means for supporting the lid disk on the container socket base, the support means being disposed
(Continued)

radially inside adjacent to the predetermined breaking means on the underside of the lid disk.

5 Claims, 3 Drawing Sheets

(51) Int. Cl.
*B65D 39/08* (2006.01)
*B65D 55/08* (2006.01)

(58) Field of Classification Search
CPC ..... B65D 55/0863; B65D 2251/0075; B65D 2251/0015; B65D 2401/25; B65D 2101/0023
USPC ..... 220/789, 661; 215/255
See application file for complete search history.

(56) References Cited

U.S. PATENT DOCUMENTS

| | | | | |
|---|---|---|---|---|
| 4,883,194 | A * | 11/1989 | Fernandes | B65D 39/08 220/296 |
| 5,156,511 | A | 10/1992 | De Smet | |
| 5,232,120 | A | 8/1993 | Dunken et al. | |
| 5,649,639 | A * | 7/1997 | Dolvet | B65D 51/1644 220/203.11 |
| 6,112,922 | A | 9/2000 | Nofer et al. | |
| 6,360,908 | B1 * | 3/2002 | Kline | B65D 51/18 220/276 |
| 6,968,968 | B2 * | 11/2005 | Buckley | B65D 55/08 220/601 |
| 7,690,525 | B2 * | 4/2010 | Schutz | B65D 47/121 220/259.3 |
| 7,958,995 | B2 | 6/2011 | Dedmon et al. | |
| 8,727,175 | B2 * | 5/2014 | Schutz | B65D 39/082 220/601 |
| 10,683,147 | B2 * | 6/2020 | Choltco-Devlin | B65D 47/265 |
| 2004/0045965 | A1 * | 3/2004 | Dwinell | B65D 39/08 220/257.2 |
| 2005/0082076 | A1 * | 4/2005 | Przytulla | B65D 1/12 174/50 |
| 2005/0092751 | A1 * | 5/2005 | Alvares | B65D 21/0219 220/276 |
| 2005/0121451 | A1 * | 6/2005 | Van Bruggen | B65D 51/18 220/257.2 |
| 2006/0096985 | A1 * | 5/2006 | Stolzman | B65D 51/1644 220/259.2 |
| 2010/0000998 | A1 * | 1/2010 | Schutz | B65D 39/082 220/288 |
| 2010/0282705 | A1 * | 11/2010 | Ledemeney | B65D 41/46 215/251 |
| 2010/0282751 | A1 * | 11/2010 | Quirijnen | F16K 24/06 220/303 |
| 2010/0301046 | A1 | 12/2010 | Schuetz | |
| 2016/0272385 | A1 | 9/2016 | Klatt | |
| 2016/0297582 | A1 * | 10/2016 | Julien | B65D 41/083 |
| 2018/0056257 | A1 | 3/2018 | Busch et al. | |
| 2018/0290800 | A1 | 10/2018 | Filho et al. | |
| 2018/0319548 | A1 | 11/2018 | Pree | |
| 2019/0344942 | A1 | 11/2019 | Klatt | |
| 2020/0290789 | A1 | 9/2020 | Weyrauch | |
| 2020/0391908 | A1 * | 12/2020 | Klatt | B65D 39/086 |

FOREIGN PATENT DOCUMENTS

| | | | |
|---|---|---|---|
| DE | 9102424 | U1 | 9/1991 |
| DE | 4041536 | A1 | 6/1992 |
| DE | 102017223074 | A1 | 6/2019 |
| EP | 2607136 | A1 | 6/2013 |
| WO | 2008139196 | A1 | 11/2008 |
| WO | 2019218023 | A1 | 11/2019 |

OTHER PUBLICATIONS

China National Intellectual Property Administration, Notice of the First Review Opinion and Search Report, Application No. 202180062585.8, Sep. 14, 2024, 7 pages [English Language Translation Only].
Republic of Colombia, Superintendency of Industry and Commerce, Office Action and Search Report, Application No. NC2023/0004431, Sep. 12, 2024, 7 pages [English Language Translation Only].
Canadian Intellectual Property Office, Office Action, U.S. Pat. No. 3,191,869, Aug. 13, 2024, 3 pages.
Japan Patent Office, Notice of Reasons for Refusal, Application No. 2023-515780, Mar. 5, 2024, 22 pages.
National Institute of Industrial Property—INAPI—Chile, Expert Report on Invention Patent Application, Application No. 202300643, Jun. 14, 2024, 10 pages [English Language Translation Only].
Australian Government—IP Australia, Examination Report No. 2, Application No. 2021338896, Nov. 13, 2024, 3 pages.
Australian Government—IP Australia, Examination Report No. 3, Application No. 2021338896, Nov. 28, 2024, 3 pages.
Egyptian Patent Office, Office Action, Application No. 2023020246, Dec. 1, 2024, 5 pages [English Language Translation Unavailable].
Korean Intellectual Property Office, Office Action, Application No. 10-2023-7011857, Feb. 12, 2025, 12 pages.

* cited by examiner

Fig. 1
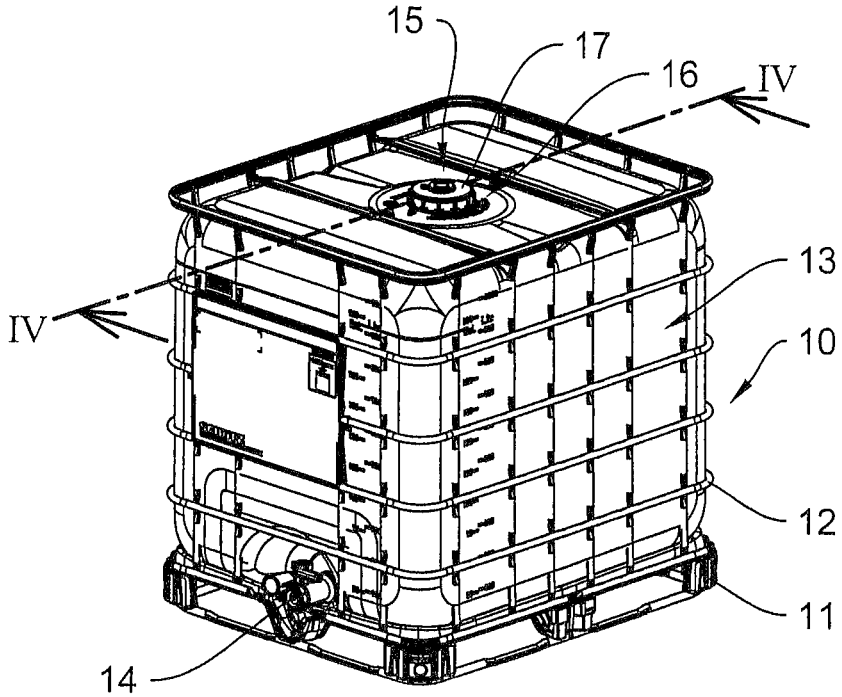
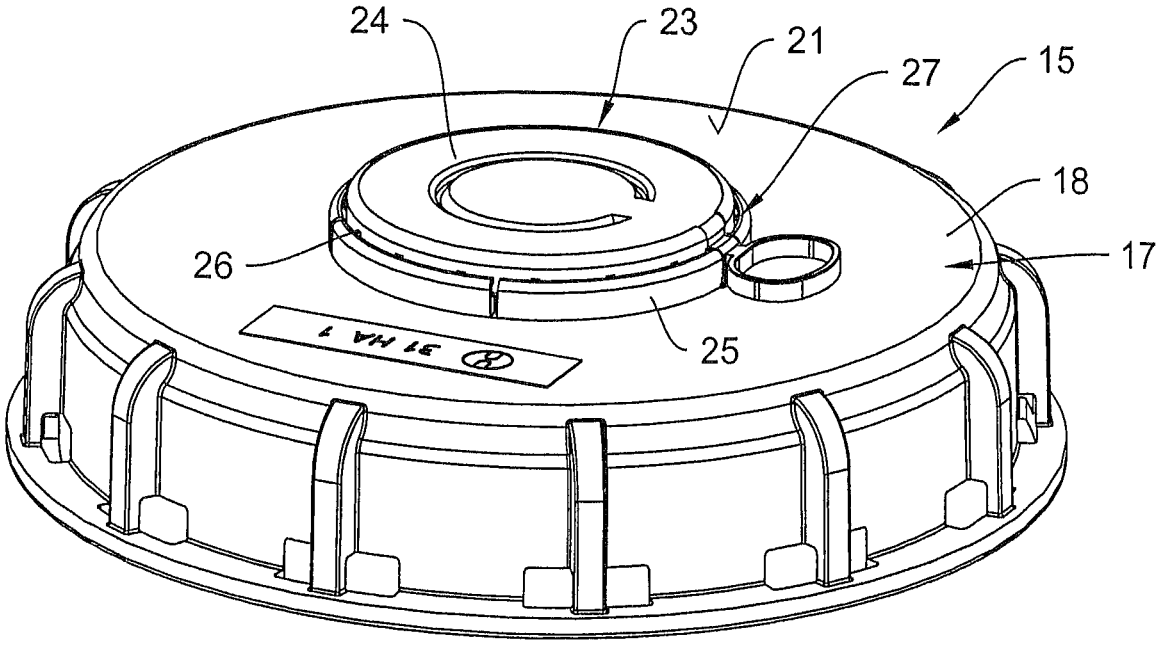
Fig. 2

Fig. 3
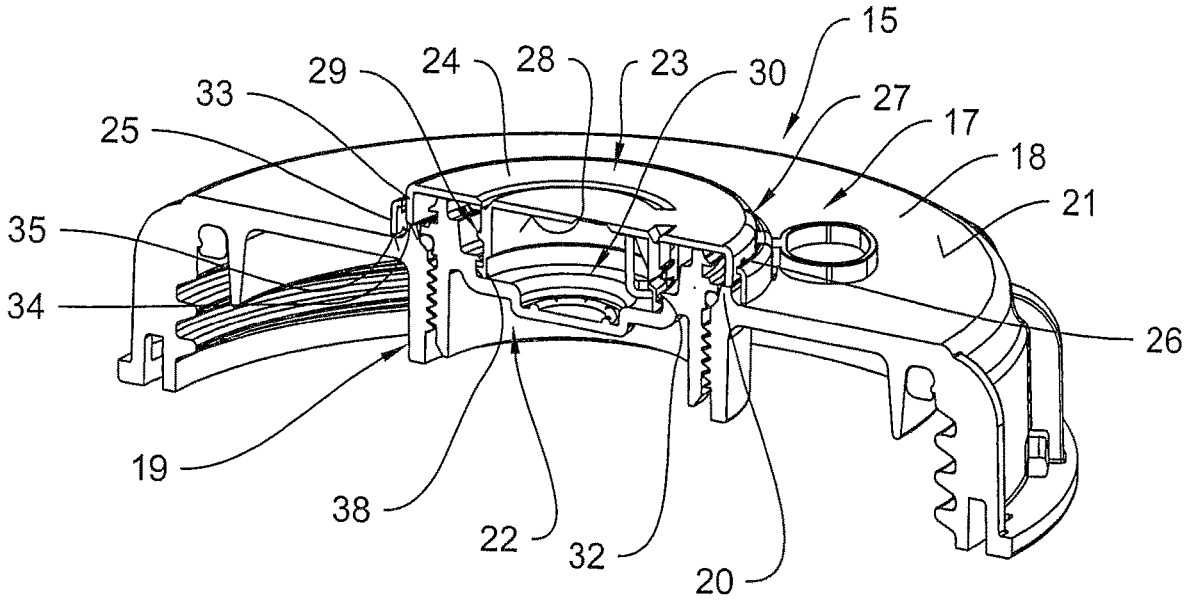
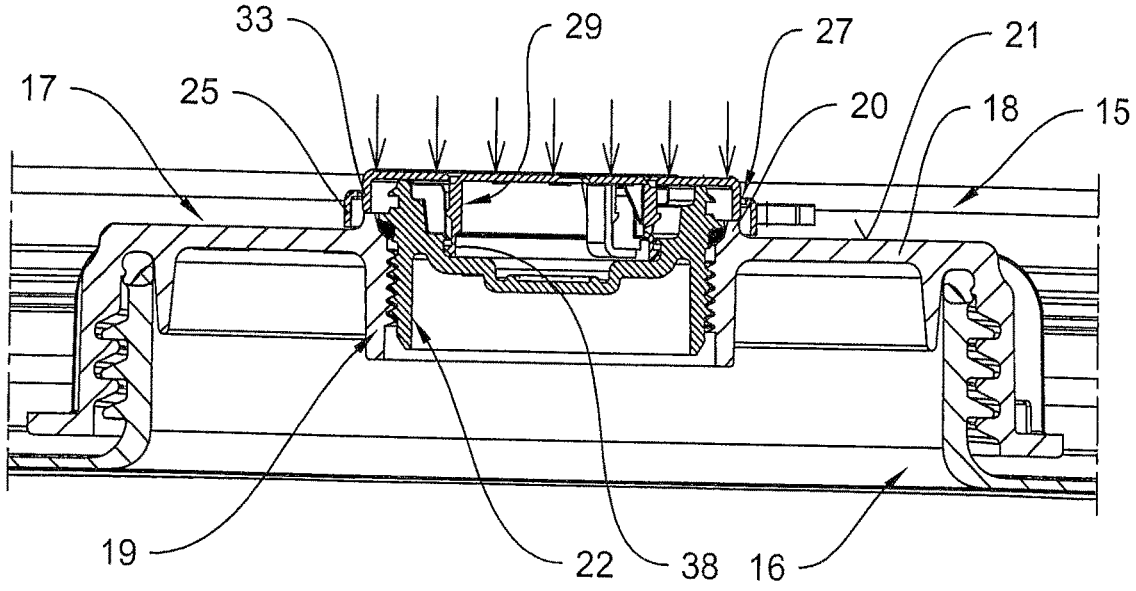
Fig. 4

SEALING CAP FOR A CONTAINER CLOSURE AND CONTAINER CLOSURE COMPRISING SUCH A SEALING CAP

The present application is a national stage application filed under 35 U.S.C. § 371 of International Application No. PCT/EP2021/069054, filed Jul. 8, 2021, which claims priority to German Patent Application No. 10 2020 123 861.4, filed Sep. 14, 2020. Each of the aforementioned patent applications is incorporated by reference in its entirety for all purposes.

The present disclosure relates to a sealing cap made of an elastic plastic material for a container closure comprising a container socket base formed on a container for disposing a container socket having a bung plug disposed in a bung socket formed on the container socket base, the sealing cap comprising a lid disk which has a fastening means disposed on the underside of the lid disk and provided with a snap-lock means for forming a snap-lock connection with the bung plug, and a an edge skirt disposed at the circumference of the lid disk and connected to the lid disk via a predetermined breaking means. Moreover, the disclosure relates to a container closure provided with such a sealing cap.

A sealing cap of the kind described above is also known from WO 2008/139196 A1. The known sealing cap, which is made of a dimensionally elastic plastic, has a snap-lock means which is disposed on the underside of the lid disk and by means of which the sealing cap is connected to a bung plug disposed in a bung socket of a container closure. The lid disk, on whose outer circumference an edge skirt connected to the lid disk via a predetermined breaking means is disposed, protrudes beyond the opening edge of the bung socket by a lid edge to which the edge skirt is connected via the predetermined breaking means. A destruction of the predetermined breaking means including an at least partial detachment of the edge skirt from the lid disk indicates that there has been an attempt to remove the sealing cap from the container closure.

The lid disk and the lid edge of the lid disk of the known sealing cap are spaced apart from the bung socket. As a result, the predetermined breaking means are destroyed not only if there is an attempt to remove the sealing cap from the container closure by reaching below the edge, but also if pressure is exerted on the lid disk from above that causes a deformation of the lid disk which is transmitted to the edge skirt via the predetermined breaking means with the result that the edge skirt rests on the wall surface of the container surrounding the bung socket. This type of load can occur in particular if containers provided with container closures are stacked improperly and the upper container placed on the lower container exerts pressure on the lid disk of the sealing cap. Damage caused to the predetermined breaking means in this way has the consequence that the manipulation protection intended by the sealing cap no longer exists and a potential subsequent manipulation of the container closure will therefore no longer be detectable.

Hence, the object of the present disclosure is to propose a sealing cap of the kind mentioned above that has improved functional reliability.

To attain this object, the sealing cap according to the disclosure has the features of claim 1.

According to the disclosure, the lid disk of the sealing cap has a support means for supporting the lid disk on the container socket base, the support means being disposed radially inside adjacent to the predetermined breaking means on the underside of the lid disk.

The support means disposed on the lid disk radially inside adjacent to the predetermined breaking means of the sealing cap according to the disclosure has the effect that once the sealing cap has been disposed on the container closure and the snap-lock connection between the bung plug has been established, there is a force fit between the support means and the container socket base of the container socket with the result that a deformation of the lid disk in the direction of the socket base due to external pressure has the effect that the outer load is discharged into the container socket base via the support means and is not introduced into the edge skirt via the predetermined breaking means.

In contrast, the fact that the lid edge of the lid disk of the known sealing cap is spaced apart from the bung socket causes the lid edge together with the predetermined breaking means disposed on the lid edge and the edge skirt connected thereto to be deflected in the direction of the container socket base, which means that the predetermine breaking means may be damaged when the edge skirt comes into contact with or rests on the container socket base. The edge skirt can be in contact with or rest on the container socket base directly or via deposits formed on the container socket base and allowing forces to flow between the edge skirt and the container socket base, deposits of this kind easily occurring during storage and transport of containers of this kind. This is particularly true if the containers are IBCs, which are typically transported and stored repeatedly.

Preferably, the support means is an edge web disposed concentrically with the edge skirt on the underside of the lid disk so that the supporting effect can be effective continuously across the entire circumference of the sealing cap.

If the edge web has a lower edge recessed relative to a lower edge of the edge skirt with respect to the underside of the lid disk, access to the lower edge of the edge web for removing the sealing cap from the bung socket is prevented since the edge skirt is disposed in such a manner that it covers the lower edge of the edge web.

If the snap-lock means of the fastening means is connected to a pull tab disposed at the circumference of the lid disk via a connection means, the connecting means having a lid strip which is formed in the lid disk and separated from adjacent areas of the edge skirt, of the edge web and of an inner part of the lid disk by lateral predetermined breaking means and connected to the snap-lock means via a pull web, the sealing cap can preferably be completely removed from the bung plug without the edge web acting as the support means preventing the removal after the predetermined breaking means formed on the edge skirt has been damaged.

In a first alternative, the container closure according to the disclosure includes a container socket base that is a lid for a container opening formed in a container wall, the lid comprising the bung socket which is disposed in a lid disk of the lid and which penetrates the lid disk in such a manner that the support means formed on the underside of the lid disk of the sealing cap rests on a top of the lid disk of the lid and the edge skirt is spaced apart from the top of the lid disk of the lid.

According to the disclosure, the container socket base is a lid for a container opening formed in a container wall, the lid comprising the bung socket which is disposed in a lid disk of the lid and which penetrates the lid disk in such a manner that the support means formed on the underside of the lid disk of the sealing cap rests on a top of the lid disk of the lid and the edge skirt is spaced apart from the top of the lid disk of the lid.

Preferably, the bung socket has an opening edge protruding from the top of the lid in such a manner that the support means rests on the opening edge of the bung socket.

A container closure according to the disclosure configured in this way allows the sealing cap according to the disclosure to be used on an IBC.

According to another alternative, the container closure according to the disclosure has a container socket base that is a wall portion of a container, the wall portion comprising a bung socket formed in the wall portion in such a manner that the support means formed on the underside of the lid disk of the sealing cap rests on a wall surface of the container and the edge skirt is spaced apart from the wall surface of the container.

The container socket base of the container closure configured according to the disclosure is a wall portion of a container, the wall portion comprising a bung socket formed in the wall portion in such a manner that the support means formed on the underside of the lid disk of the sealing cap rests on a wall surface of the container and the edge skirt is spaced apart from the wall surface of the container.

A container closure configured according to the disclosure in this way allows the sealing cap according to the disclosure to be used on any container, in particular a drum.

A preferred embodiment of the disclosure will be discussed in more detail below with reference to the drawing.

FIG. 1 is an isometric illustration of an IBC comprising a container closure disposed on the top of an inner container of the IBC;

FIG. 2 is an individual illustration of the container closure illustrated in FIG. 1;

FIG. 3 is a section view of the container closure illustrated in FIG. 2;

FIG. 4 is a section view of the container closure disposed on a container opening of the IBC illustrated in FIG. 1 along line IV-IV in FIG. 1;

Figure 5:
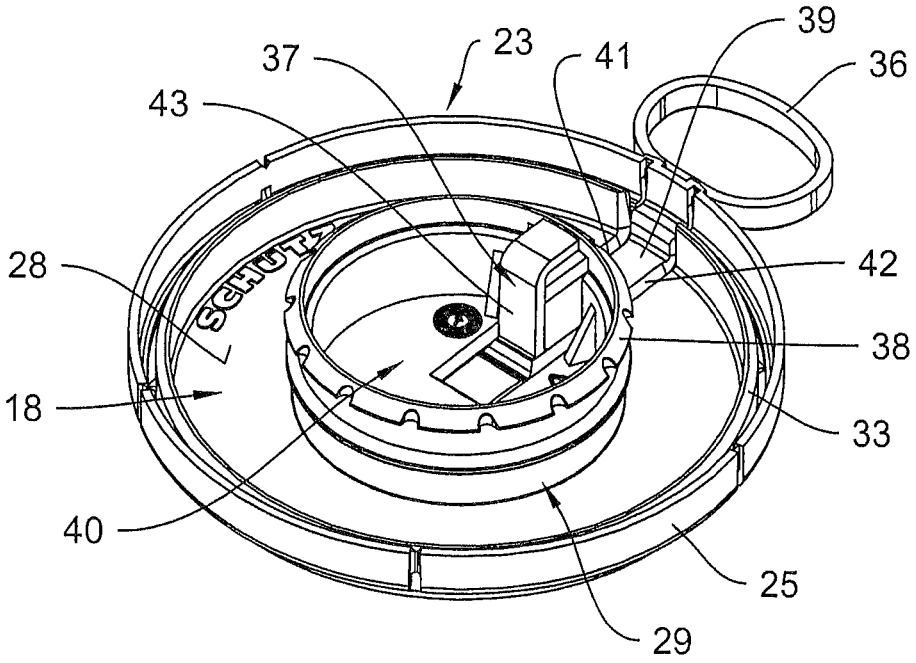
FIG. 5 is a bottom view of the sealing cap of the container closure illustrated in FIG. 2.

FIG. 1 shows a transport and storage container 10, which is also referred to as an IBC and which has an inner container 13 disposed on a transport pallet 11 and accommodated in a cage 12, inner container 13 being provided with a container fitting 14 on a front side and with a container opening 16, which can be closed with a container closure 15, at a top.

As illustrated in FIGS. 2 to 4, container closure 15 has a lid 17, which is a screw top in the case at hand and screwed to an opening edge of container opening 16. A bung socket 19 is disposed in a lid disk 18 of lid 17, bung socket 19 penetrating lid disk 18 in such a manner that an opening edge 20 of bung socket 19 protrudes from a top 21 of lid disk 18.

As shown in FIG. 4 in particular, a bung plug 22 is screwed into bung socket 19, bung plug 22 closing bung socket 19. A sealing cap 23 is located on top of bung plug 22, sealing cap 23 comprising a lid disk 24 and an edge skirt 25, which is sleeve-shaped in the case at hand and extends essentially perpendicular to lid disk 11, edge skirt 25 being connected to lid disk 24 via a predetermined breaking means 27, which has predetermined breaking webs 26, as is shown in FIG. 2 in particular.

As shown in FIG. 3 in particular, lid disk 24 is provided with a fastening means 29 on its underside 28, fastening means 29 being a fastening ring in the case at hand and engaging a plug depression 30 of bung plug 19 in such a manner that a snap-lock means 38 formed on the lower end of fastening means 29 engages a mating snap-lock means 32 formed in plug depression 30. As further shown in FIG. 3, lid disk 24 is provided with a support means, which is an edge web 33, on its underside 28 radial inside adjacent to predetermined breaking means 27, a lower edge 34 of edge web 33 resting on opening edge 20 of bung socket 19 disposed on top 21 of lid 17.

As FIG. 4 in particular clearly shows, edge skirt 25 of the configuration example illustrated is connected to edge web 33 via predetermined breaking means 27. Edge skirt 25 covers lower edge 34 of edge web 33, which rests on opening edge 20, since lower edge 34 is recessed relative to a lower edge 35 of edge skirt 25.

If pressure is exerted on lid disk 24 as indicated by the force arrows in FIG. 4, a corresponding load is introduced into lid 17 through a force fit via edge web 33, which rests on top 21 of lid disk 18 of lid 17, more precisely on opening edge 20 of bung socket 19 in this case, without edge skirt 25 being loaded and reaction forces due to the loading of edge skirt 25 possibly acting on predetermined breaking means 27. So the manipulation safeguard formed in this case by edge skirt 25, which is connected to lid disk 18 via predetermined breaking means 27, is not affected by external loads acting on lid disk 24 of sealing cap 23.

On the other hand, sealing cap 23 is configured in such a manner that sealing cap 23 can be removed as a continuous unit from container closure 15, in particular after predetermined breaking means 27 has been destroyed, without the support means, which is edge web 33 in this case, preventing the removal. As illustrated in FIG. 5 in particular, a pull tab 36 formed on edge skirt 25 is connected to snap-lock means 38, which is formed on fastening means 29, via a connecting means 37, which has a lid strip 39, which extends from pull tab 36 via edge skirt 25 and edge web 33 into a central inner part 40 of lid disk 24 and is separated from adjacent portions of edge skirt 25, of edge web 33 and of inner part 40 of lid disk 24 by lateral predetermined breaking means 41 and 42. Lid strip 39 is connected to snap-lock means 38 of fastening means 29 via a pull web 43 in such a manner that when pull tab 36 is moved diagonally upward to the center of the lid disk, lid strip 39 is detached along predetermined breaking means 41 and 42, and snap-lock means 38, which is formed on fastening ring 29, is deformed radially inward via pull web 43, which is connected to inner part 40 of lid disk 24, with the result that sealing cap 23 can be removed from lid 17 as a continuous unit.

The invention claimed is:

1. A container closure comprising:

a container socket base wherein the container socket base is a lid for a container opening formed in a container wall, the lid comprising a bung socket which is disposed in a lid disk of the lid and which penetrates the lid disk of the lid;

a sealing cap comprising a sealing cap lid disk which has a fastening means disposed on an underside of the sealing cap lid disk, the sealing cap lid disk provided with a snap-lock means for forming a snap-lock connection with a bung plug; and an edge skirt disposed at the circumference of the sealing cap lid disk and connected to the sealing cap lid disk via a predetermined breaking means, wherein the sealing cap lid disk has a support means for supporting the sealing cap lid disk on the container socket base, the support means being disposed radially inside adjacent to the predetermined breaking means on the underside of the sealing cap lid disk, and wherein the support means rests on a top of the lid disk of the lid and the edge skirt is spaced apart from the top of the lid disk of the lid.

2. The container closure according to claim 1, wherein the bung socket has an opening edge which protrudes from a top of the lid in such a manner that the support means rests on the opening edge of the bung socket.

3. The container closure according to claim 2, wherein the support means is an edge web formed on the underside of the sealing cap lid disk and disposed concentrically with the edge skirt.

4. The container closure according to claim 3, wherein the edge web has a lower edge which is recessed relative to a lower edge of the edge skirt with respect to the underside of the sealing cap lid disk.

5. The container closure according to claim 3, wherein the snap-lock means is connected to a pull tab disposed at the circumference of the sealing cap lid disk via a connecting means, the connecting means having a lid strip which is formed in the sealing cap lid disk and which is separated from adjacent areas of the edge skirt, the edge web, and an inner part of the sealing cap lid disk by a lateral predetermined breaking means and wherein the lid strip is connected to the snap-lock means via a pull web.

* * * * *